US005577821A

United States Patent [19]

Chu

[11] Patent Number: 5,577,821

[45] Date of Patent: Nov. 26, 1996

[54] SLIDING TRACK ASSEMBLY FOR DRAWERS

[76] Inventor: Leo Chu, 5F., No. 38, Lane 239, Chin Ping Rd., Chungho City, Taipei Hsien, Taiwan

[21] Appl. No.: 409,454

[22] Filed: Mar. 24, 1995

[51] Int. Cl.[6] ..... A47B 88/00

[52] U.S. Cl. ..... 312/334.11; 312/334.1; 312/334.7; 312/334.8; 312/330.1; 384/18; 384/21

[58] Field of Search ..... 312/334.11, 334.1, 312/334.7, 334.8, 330.1; 384/18, 21, 22

[56] References Cited

U.S. PATENT DOCUMENTS

| | | | |
|---|---|---|---|
| 4,549,773 | 10/1985 | Papp et al. | 384/21 X |
| 4,993,847 | 2/1991 | Hobbs | 384/18 X |
| 4,998,828 | 3/1991 | Hobbs | 384/18 |
| 5,002,402 | 3/1991 | Parvin | 384/21 |
| 5,033,805 | 7/1991 | Hobbs | 312/334.11 |
| 5,085,523 | 2/1992 | Hobbs | 384/18 X |
| 5,255,983 | 10/1993 | Parvin | 384/21 |
| 5,316,389 | 5/1994 | Hoffman | 384/18 |
| 5,411,333 | 5/1995 | Hoffman | 384/18 |
| 5,466,060 | 11/1995 | Hoffman | 312/334.11 X |
| 5,484,209 | 1/1996 | Weng | 384/18 |

*Primary Examiner*—Peter M. Cuomo
*Assistant Examiner*—Rodney B. White
*Attorney, Agent, or Firm*—Varndell Legal Group

[57] ABSTRACT

A sliding track assembly including an outer rail securely fixed to the inside wall of a cabinet, an intermediate rail, an rail securely fixed to a drawer at one lateral side, a first sliding ball rack slidably connected between the outer rail and the intermediate rail, and a second sliding ball rack slidably connected between the intermediate rail and the inner rail, a first stop plate fixed to the intermediate rail at an outer end and having two projecting blocks for engagement with a second stop plate on the inner rail and two stop rods for stopping the second sliding ball rack in place, and a second stop plate fixed to the inner rail at an outer side to engage with the projecting blocks of the first stop plate so as to stop the drawer in place when the drawer is pulled out. The second stop plate has a projecting block at one end fitted into a locating hole on the inner rail, a forked tail fastened to a retainer rod on the inner rail, a retaining portion suspended between the projecting block and the forked tail for engagement with the projecting blocks of the first stop plate, and a press portion connected between the retaining portion and the forked tail and depressed to disengage the retaining portion from the projecting blocks of the first stop plate for allowing the drawer to be disconnected from the cabinet.

7 Claims, 19 Drawing Sheets

SLIDING TRACK ASSEMBLY FOR DRAWERS

BACKGROUND AND SUMMARY OF THE INVENTION

The present invention relates to a sliding track assembly for drawers, and relates more particularly to such a sliding track assembly which can be conveniently installed by an automatic mounting machine without the use of any rivet.

Figures from 1 to 4 show a sliding track assembly for drawers according to the prior art, which is generally comprised of an outer rail for fastening the inside wall of the cabinet, table, desk, etc., an intermediate rail, an inner rail for fastening to the drawer at one lateral side, a first sliding ball rack slidably connected between the outer rail and the intermediate rail, a second sliding ball rack slidably connected between the intermediate rail and the inner rail, a stop plate fixedly secured to the outer end of the intermediate rail, and a pawl turned about a pivot on the inner rail. This structure of sliding track assembly is still not satisfactory in function. When the drawer is pulled out of the cabinet, the pawl tends to be deformed by the stop plate. When the inner rail is inserted into the intermediate rail, the pawl will be squeezed by the stop plate, therefore the stop plate and the pawl wear with use quickly. When the pawl or the stop plate has begun to wear, the inner rail will disconnect from the intermediate rail when the drawer is pulled out of the cabinet. Because the pawls of the two sliding track assemblies at two opposite sides of the drawer must be turn ed in different directions so that the drawer can be disconnected from the cabinet, the parts of the sliding track assemblies may be damaged when the pawls are not turned correctly. Furthermore, when inserting the inner rail into the intermediate rail, the inside end of the inner rail may be stopped against the outer end of the second sliding ball rack, causing the second sliding ball rack to be damaged or the inner rail unable to be inserted into position.

Figures from 5 to 13 show another structure of sliding track assembly for drawers according to the prior art, which is generally comprised of an outer rail for fastening to the inside wall of the cabinet, table, desk, etc., an intermediate rail, an inner rail for fastening to the drawer at one lateral side, a first sliding ball rack slidably connected between the outer rail and the intermediate rail, a second sliding ball rack slidably connected between the intermediate rail and the inner rail, a first stop plate fixedly secured to the outer end of the intermediate rail, and a second stop plate fastened to the inner rail by rivets. This structure of sliding track assembly also has draybacks. One drawback of this structure of sliding track assembly is that the second stop plate tends to displace. If the second stop plate is not disposed in parallel with the inner rail perfectly, the inner rail tends to disconnect from the intermediate rail when the drawer is pulled out of the cabinet. Another drayback of this structure of sliding track assembly is the complicated mounting process of the second stop plate. Still another drawback is that the inside end of the inner rail may be stopped against the outer end of the second sliding ball rack when inserting the drawer into the cabinet. If the inside end of the inner rail is stopped against the outer end of the second sliding ball rack, the drawer cannot be inserted into position. If the drawer is forced into position, the second sliding ball rack will be damaged.

The present invention has been accomplished to provide a sliding track assembly for drawers which eliminates the aforesaid drawbacks.

According to one aspect of the present invention, the sliding track assembly comprises an outer rail securely fixed to the inside wall of a cabinet, an intermediate rail, an inner rail fixedly secured to a drawer at one lateral side, a first sliding ball rack slidably connected between the outer rail and the intermediate rail, and a second sliding ball rack slidably connected between the intermediate rail and the inner rail, a first stop plate fixed to the intermediate rail at an outer end and having two projecting blocks for engagement with a second stop plate on the inner rail and two stop rods for stopping the second sliding ball rack in place, a second stop plate fixed to the inner rail at an outer side to engage with the projecting blocks of the first stop plate so as to stop the drawer in place when the drawer is pulled out of the cabinet, wherein the second stop plate has a projecting block at one end fitted into a locating hole on the inner rail, a forked tail fastened to a retainer rod on the inner rail, a retaining portion suspended between the projecting block and the forked tail for engagement with the projecting blocks of the first stop plate, and a press portion connected between the retaining portion and the forked tail and depressed to disengage the retaining portion from the projecting blocks of the first stop plate for allowing the drawer to be disconnected from the cabinet.

According to another aspect of the present invention, the first stop plate has two stop rods with a respective projecting portion. When the drawer is moved out of the cabinet and disconnected from it, the projecting portions are stopped at a respective projecting portion on the second sliding ball rack. Therefore, when the drawer is inserted into the cabinet again, the front end of the inner rail can be smoothly moved over the stop rods into the second sliding ball rack without being constrained by the projecting portions of the second sliding ball rack.

According to still another aspect of the present invention, the inner rail has a through hole corresponding to the retaining portion of the second stop plate, therefore the retaining portion can be forced to curve into the through hole on the inner rail and to disengage from the projecting blocks of the first stop plate when the press portion of the second stop plate is depressed.

According to still another aspect of the present invention, the first stop plate is made from plastics, having an arched front end projecting out of the intermediate rail, therefore when the drawer is moved out of the cabinet or pushed back inside the cabinet, little noise will be produced.

DETAILED DESCRIPTION OF THE PREFERRED EMBODIMENT

Figure 1:
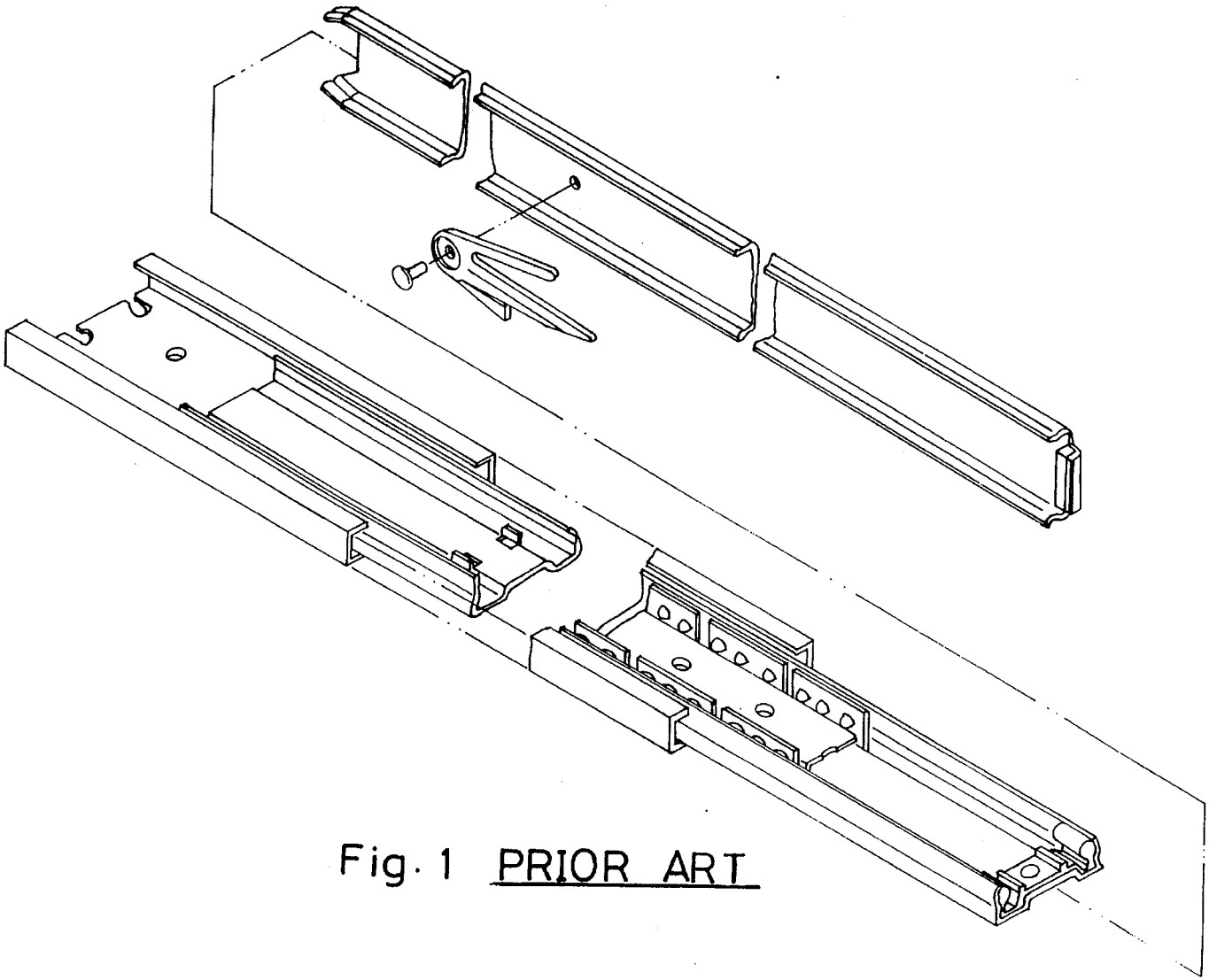
Fig. 1 PRIOR ART
FIG. 1 is an exploded view of a sliding track assembly for drawers according to the prior art.
Figure 2:
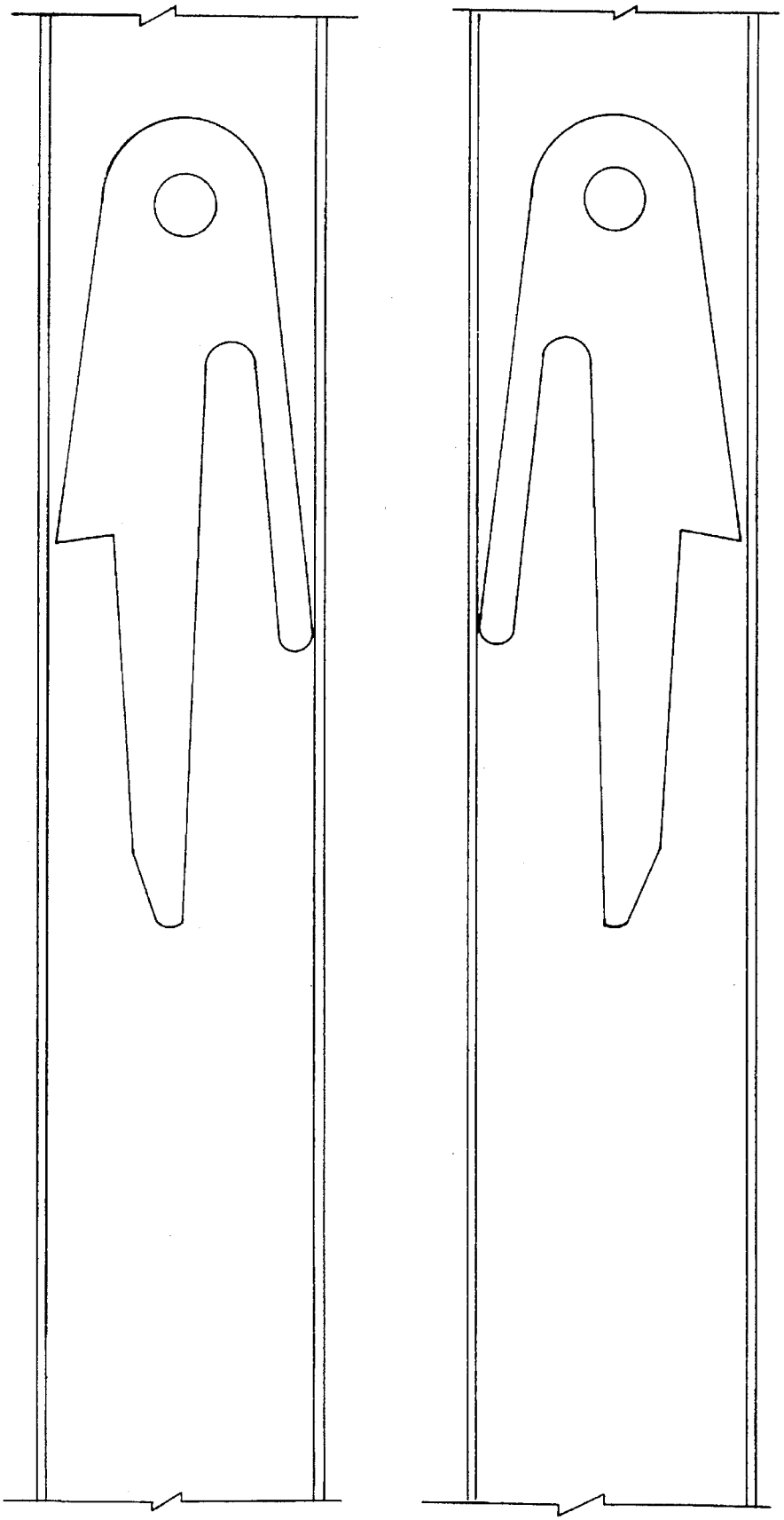
Fig. 2 PRIOR ART
FIG. 2 is a plain view of the left-sided outer rail and the right-sided outer rail for the left-sided sliding track assembly and the right-sided sliding track assembly according to the prior art.
Figure 3:
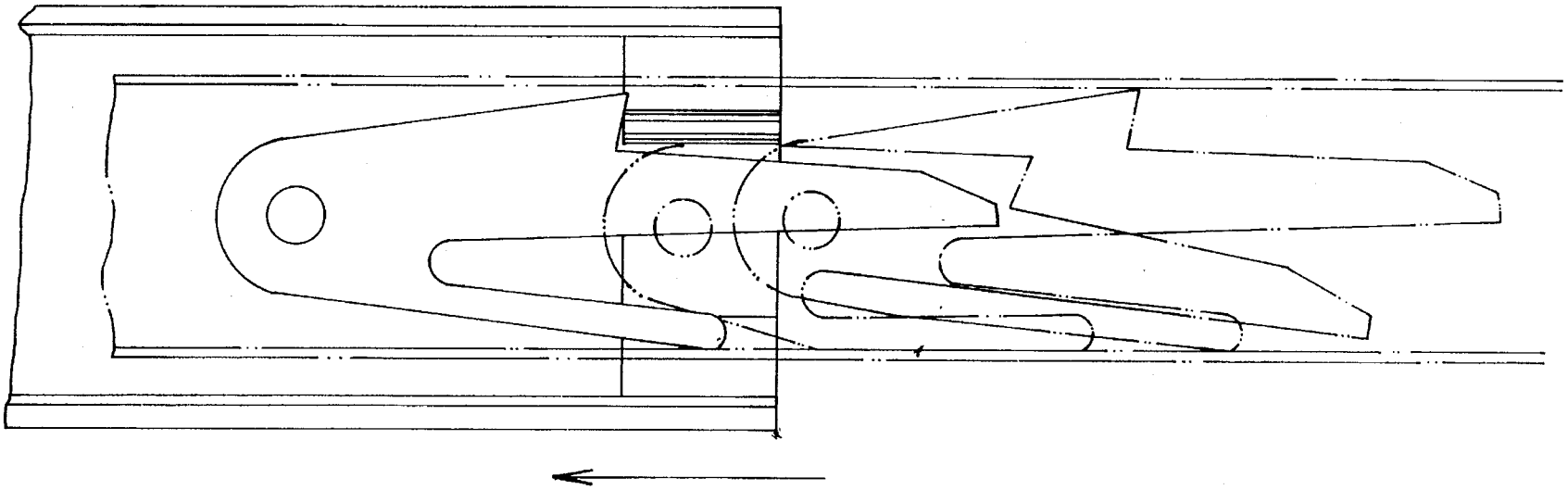
Fig. 3 PRIOR ART
FIG. 3 is a schematic drawing showing the outer rail moved into the intermediate rail according to the prior art.
Figure 4:
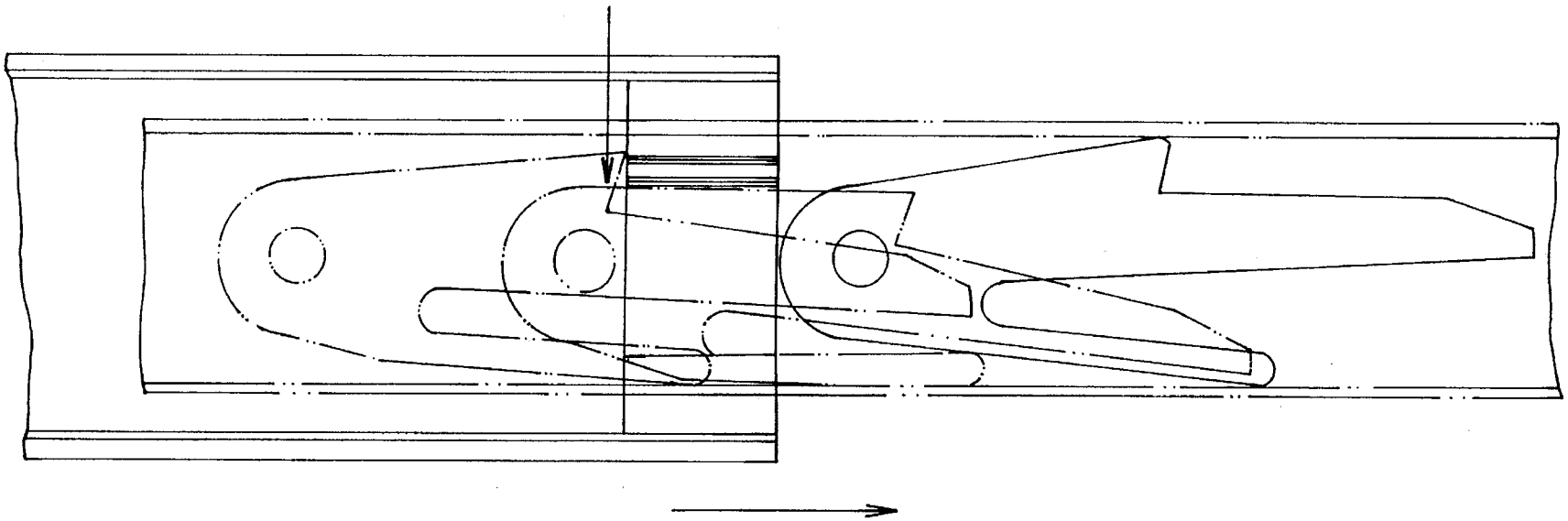
Fig. 4 PRIOR ART
FIG. 4 is a schematic drawing showing the outer rail moved out of the intermediate rail according to the prior art.
Figure 5:
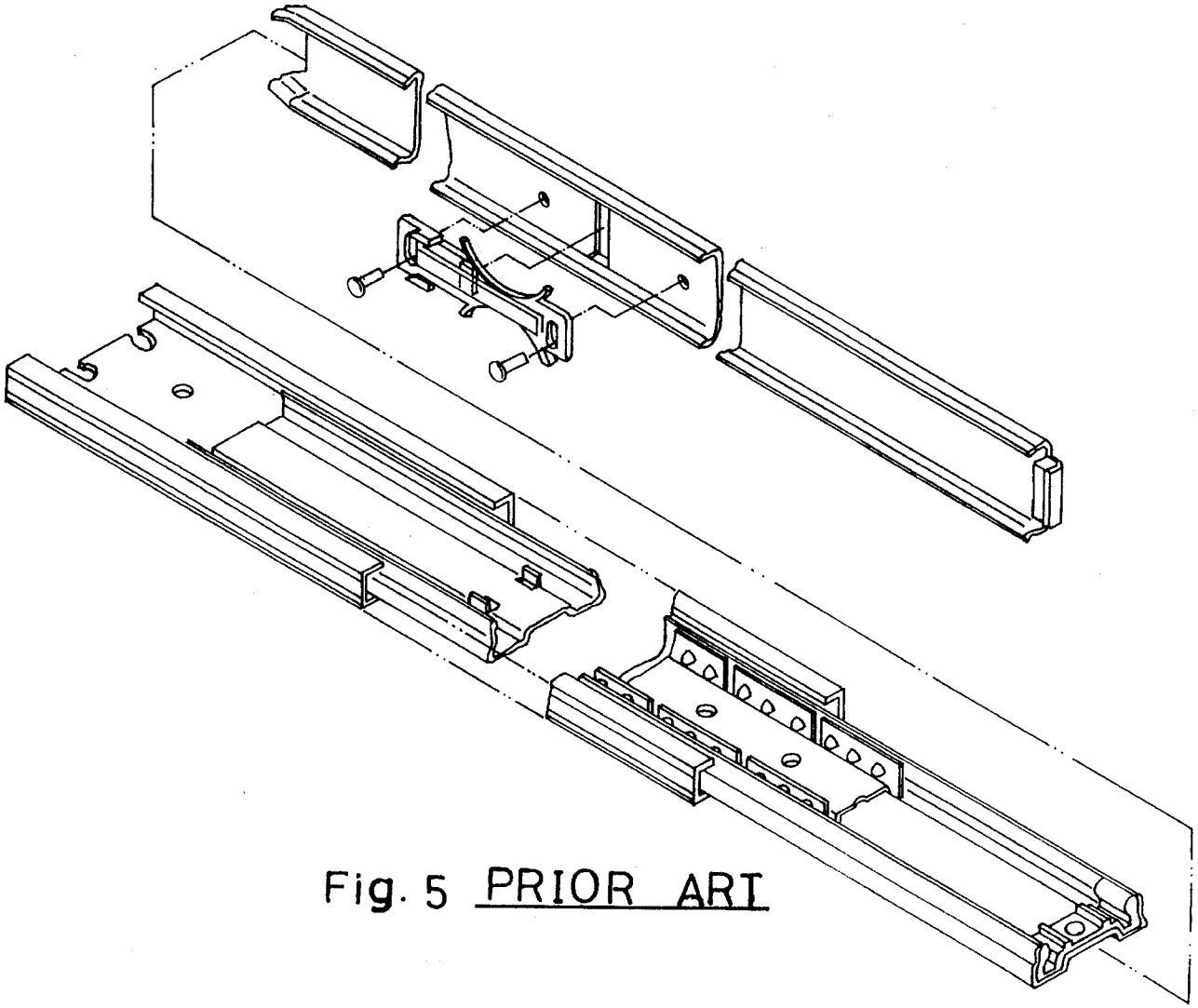
Fig. 5 PRIOR ART
FIG. 5 is an exploded view of another structure of sliding track assembly for drawers according to the prior art.
Figure 6:
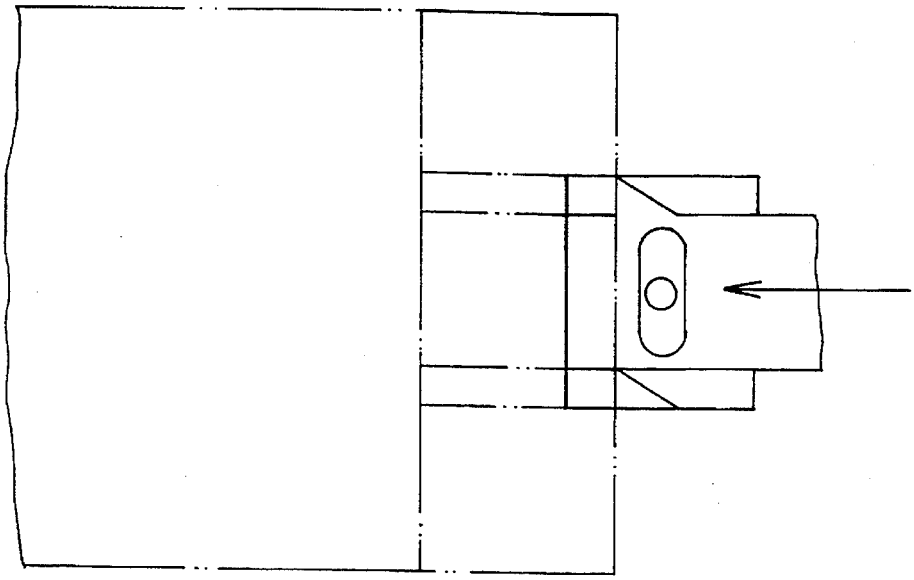
Fig. 6 PRIOR ART
FIGS. 6 to 9 are schematic drawings showing the continuous action of the insertion of the outer rail of the sliding track assembly of FIG. 5 into the respective intermediate rail.
Figure 7:
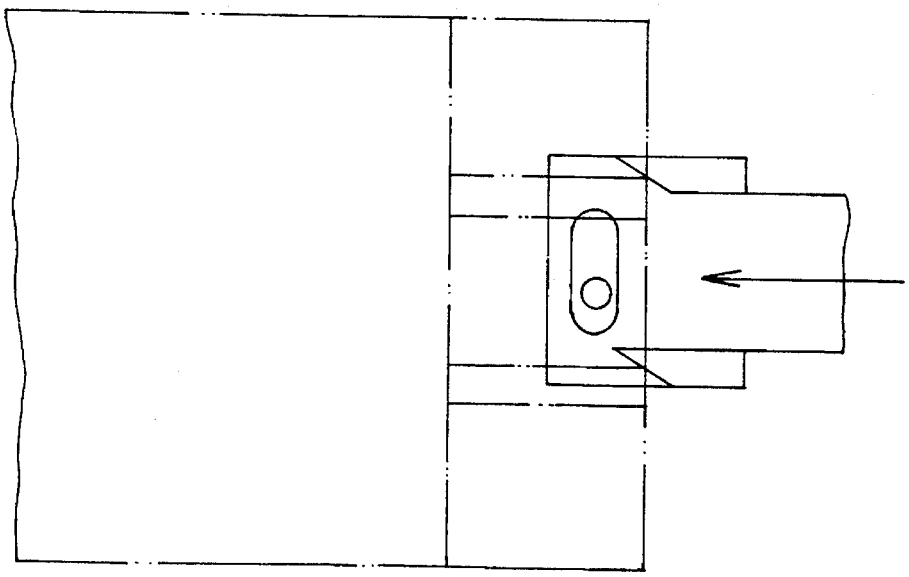
Fig. 7 PRIOR ART
Figure 8:
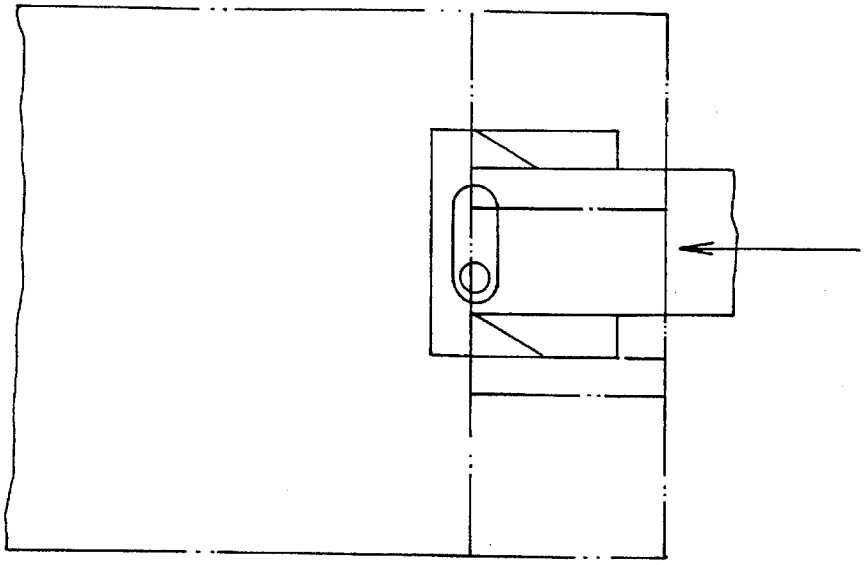
Fig. 8 PRIOR ART
Figure 9:
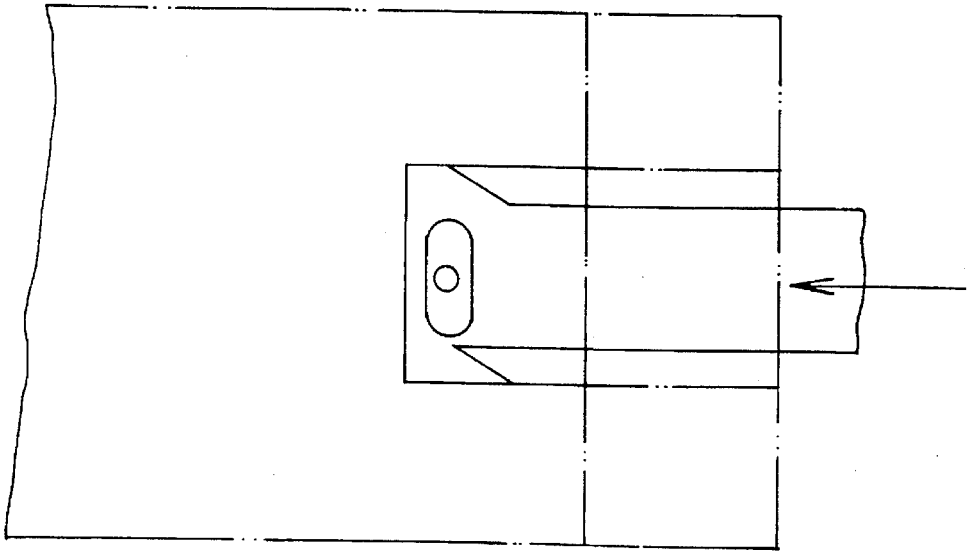
Fig. 9 PRIOR ART
Figure 10:
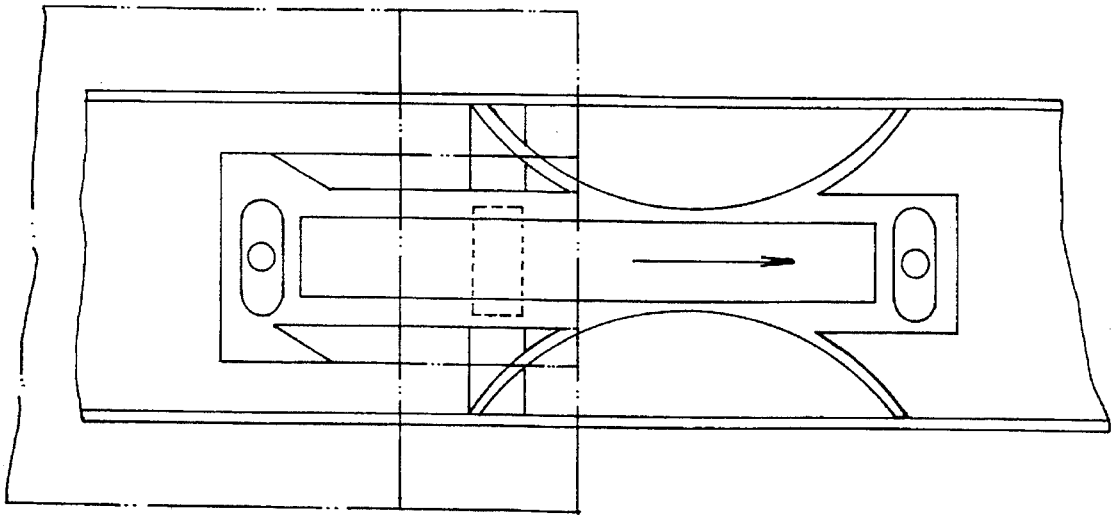
Fig. 10 PRIOR ART
FIGS. 10 to 13 are schematic drawings showing the continuous action of the disconnection of the outer rail of the sliding track assembly of FIG. 5 from the respective intermediate rail.
Figure 11:
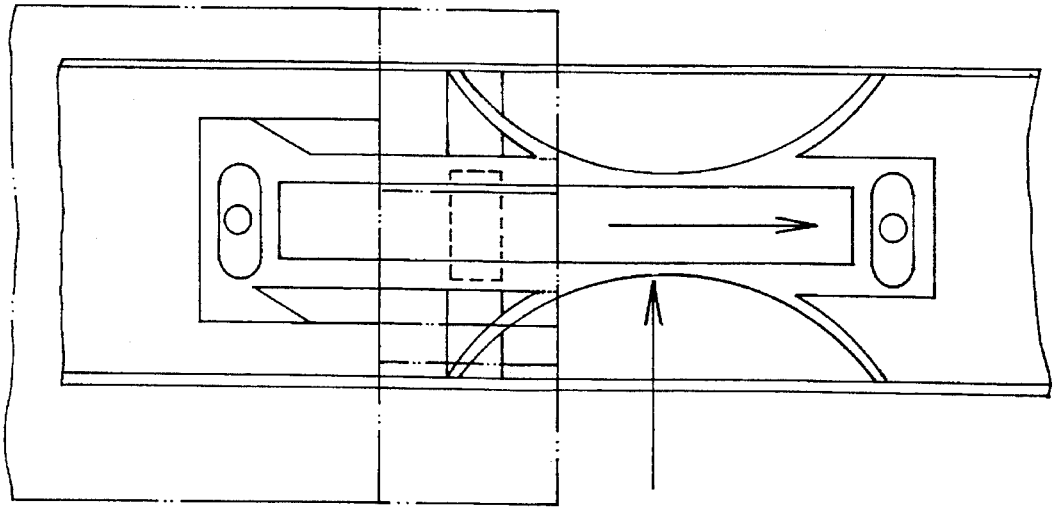
Fig. 11 PRIOR ART
Figure 12:
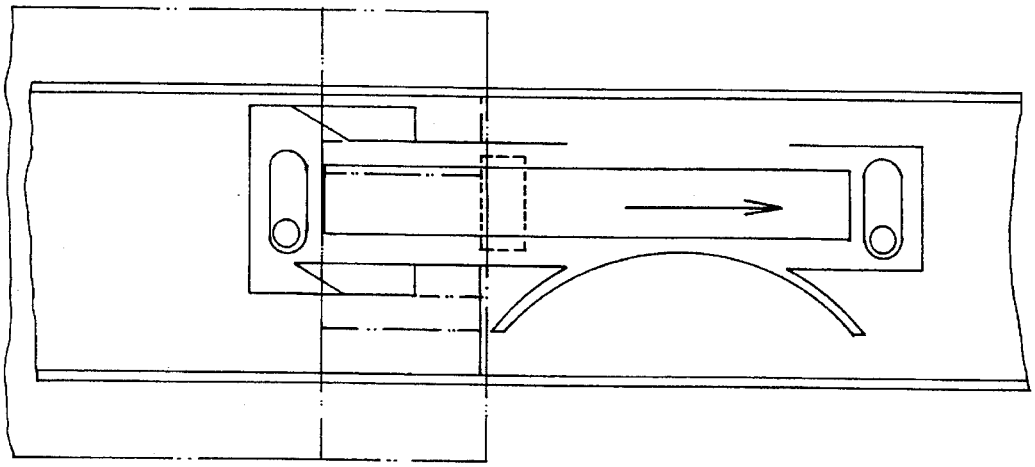
Fig·12 PRIOR ART
Figure 13:
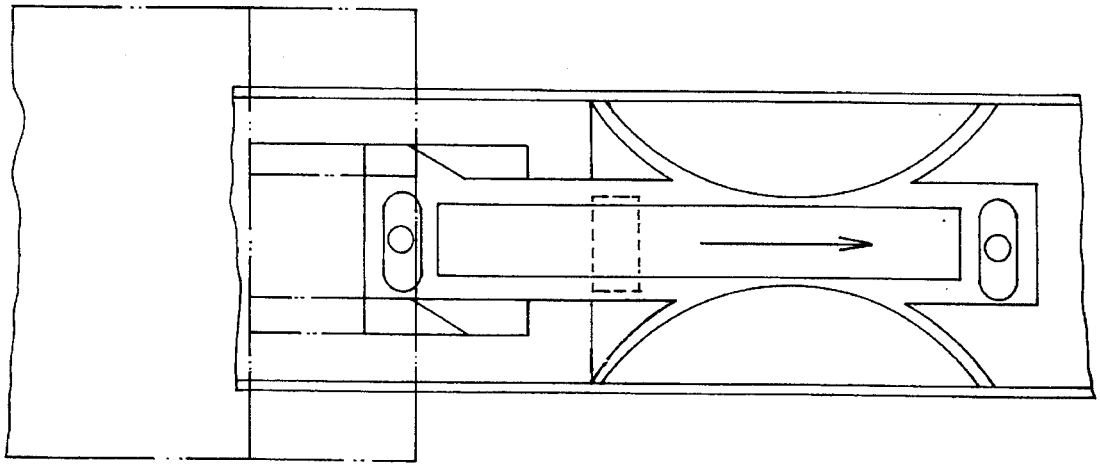
Fig·13 PRIOR ART
Figure 14:
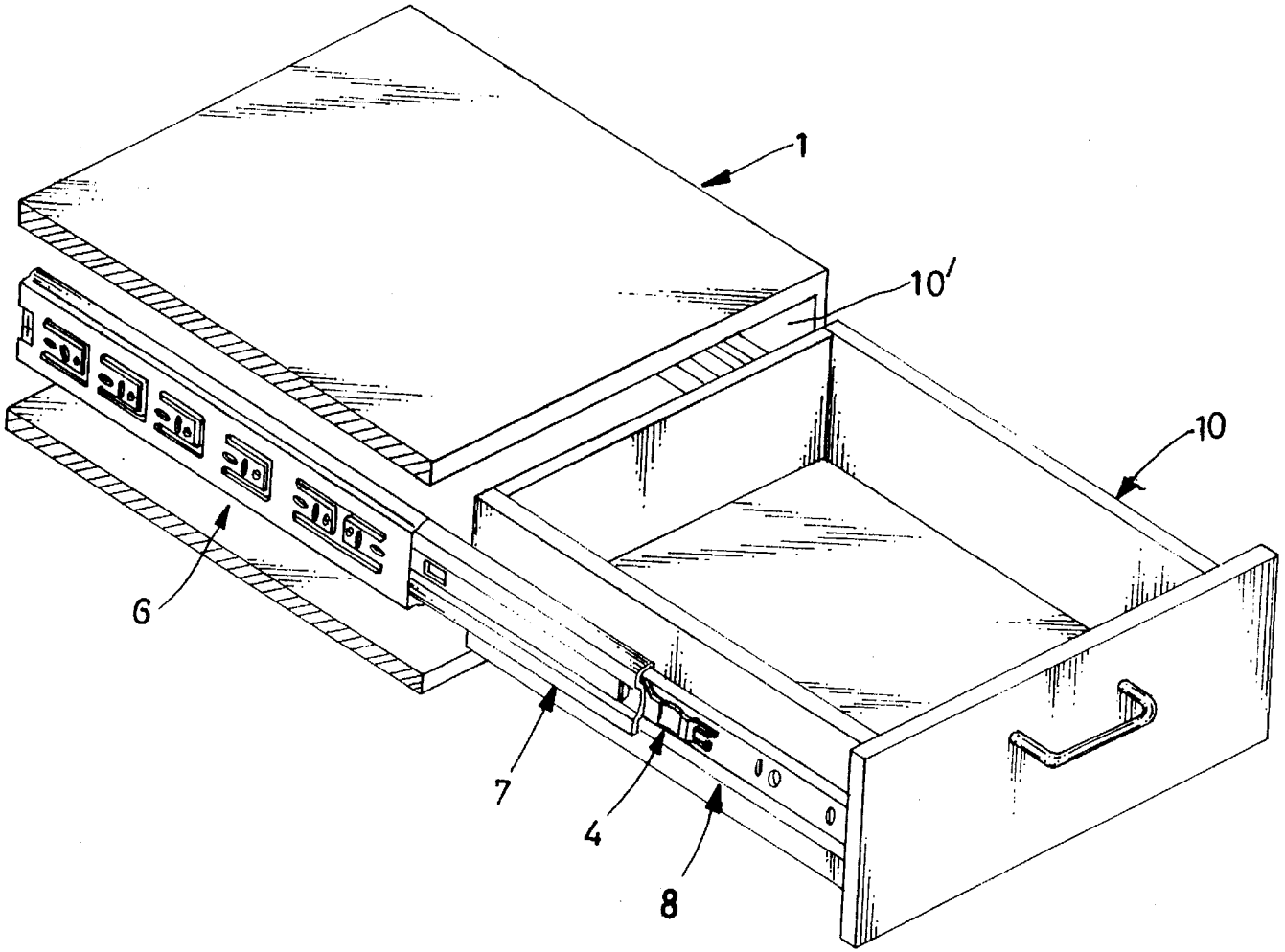
FIG. 14 is an installed view of a sliding track assembly according to the present invention.
Figure 15:
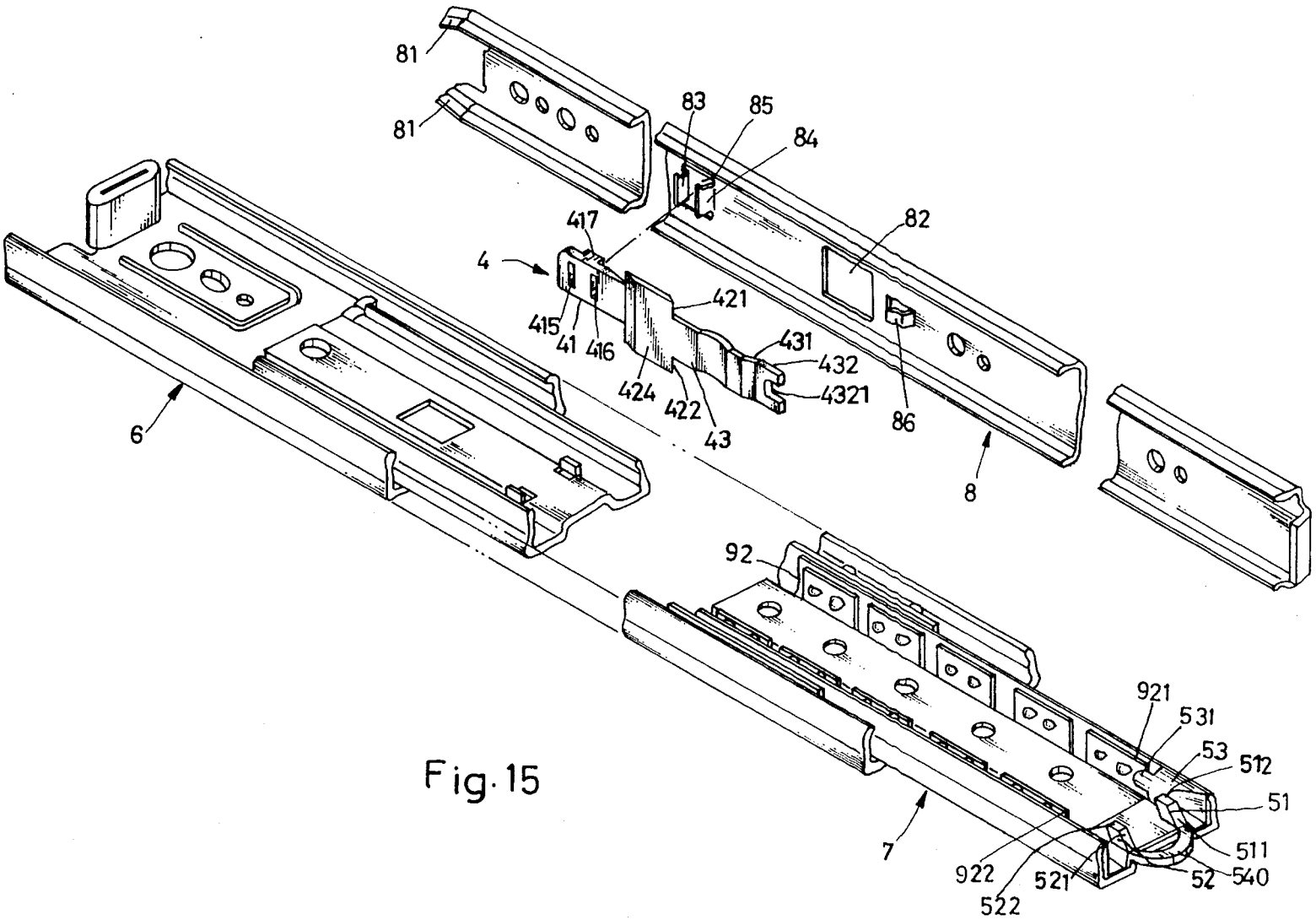
FIG. 15 is an exploded view of the sliding track assembly shown in FIG. 14.

Referring to FIGS. 14 and 15, a sliding track assembly in accordance with the present invention is generally comprised of an outer rail 6 securely fixed to the inside wall 10' of the cabinet 1, an intermediate rail 7, an inner rail 8 fixedly secured to the drawer 10 at one lateral side, a first sliding ball rack (not shown) slidably connected between the outer rail 6 and the intermediate rail 7, and a second sliding ball rack 92 slidably connected between the intermediate rail 7 and the inner rail 8. A first stop plate 5 is fixed to the outer open end of the intermediate rail 7, having two projecting blocks 51 and 52 for engagement with a second stop plate 4 on the inner rail 8 and two stop rods 53 for stopping the second sliding ball rack 92 in place. The second stop plate 4 is fixed to the inner rail 8 at an outer side. When the drawer 10 is moved out of the cabinet 1, the inner rail 8 is engaged with the projecting blocks 51 and 52 of the first stop plate 5, and therefore the drawer 10 does not disconnect from the cabinet 1.

Figure 16:
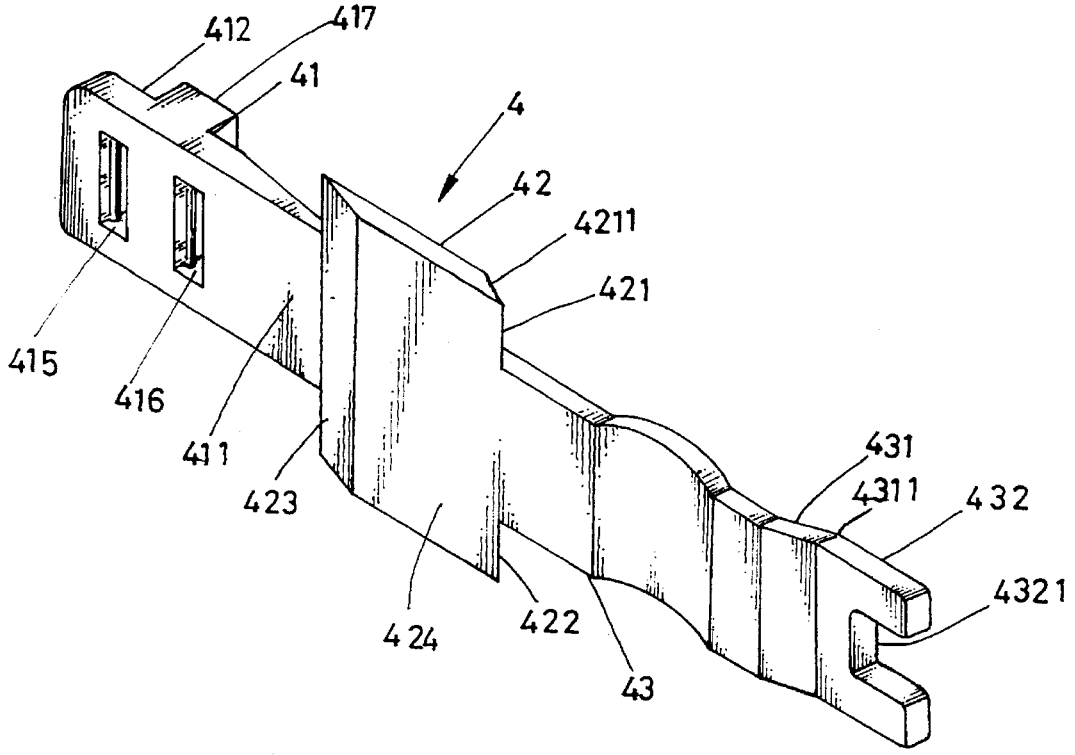
FIG. 16 is an elevational view in an enlarged scale of the second stop plate according to the present invention.
Figure 17:
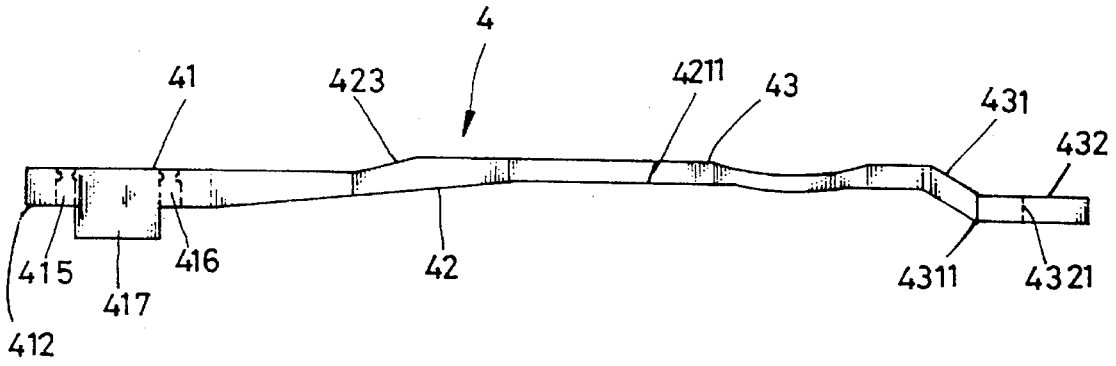
FIG. 17 is a side view of the second stop plate shown in FIG. 16.
Figure 19:
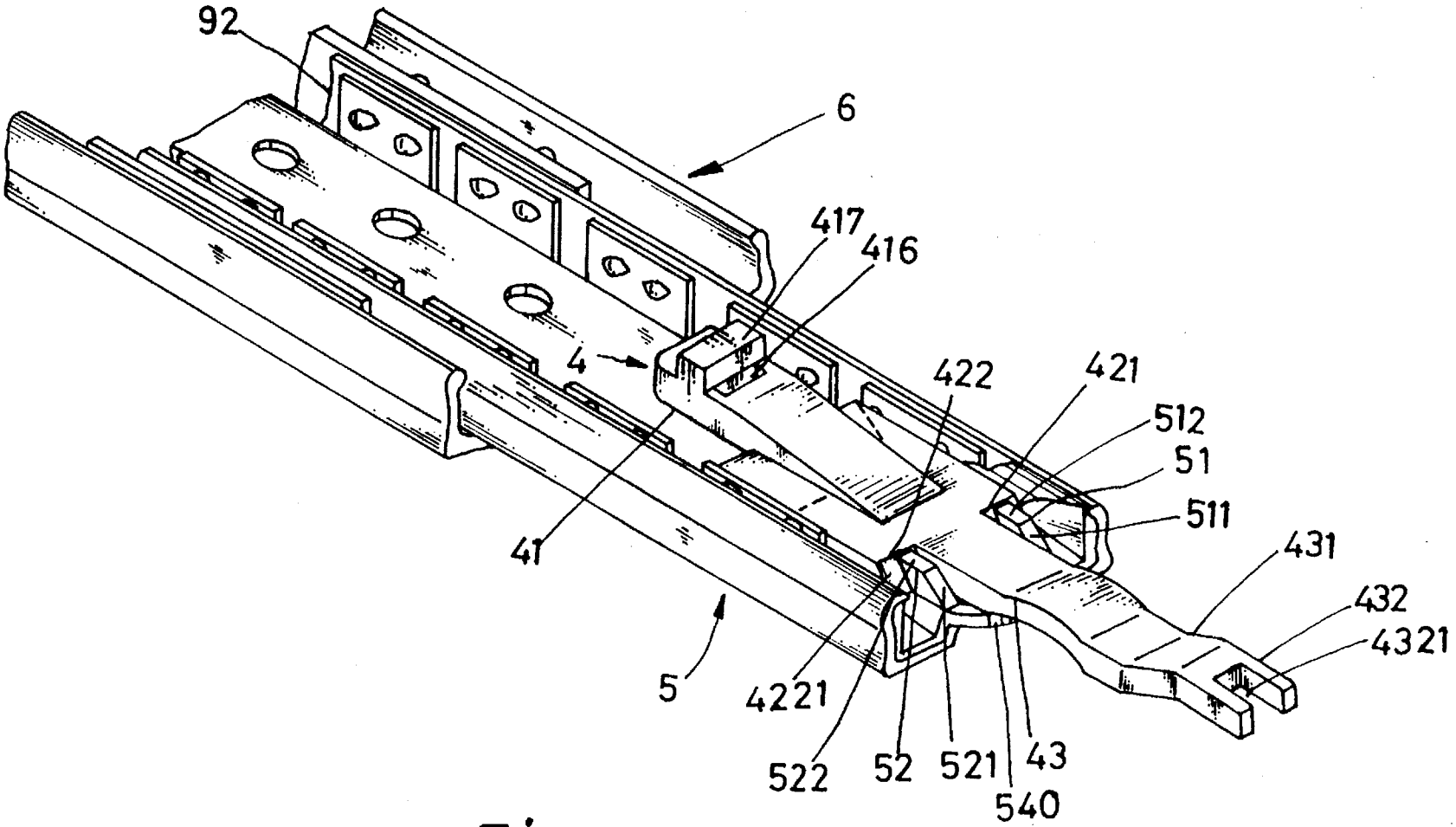
FIG. 19 shows the second stop plate engaged with the first stop plate within the intermediate rail inside the outer rail according to the present invention.
Figure 18:
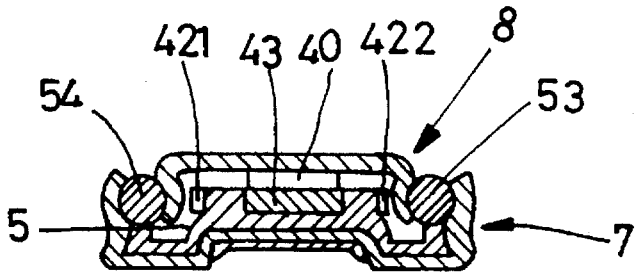
FIG. 18 is a cross sectional view showing the sliding track assembly of FIG. 14 assembled.
Figure 20:
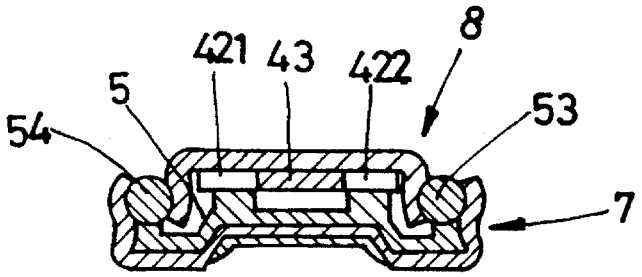
FIG. 20 is similar to FIG. 18 but showing the second stop plate disengaged from the first stop plate.
Figure 21:
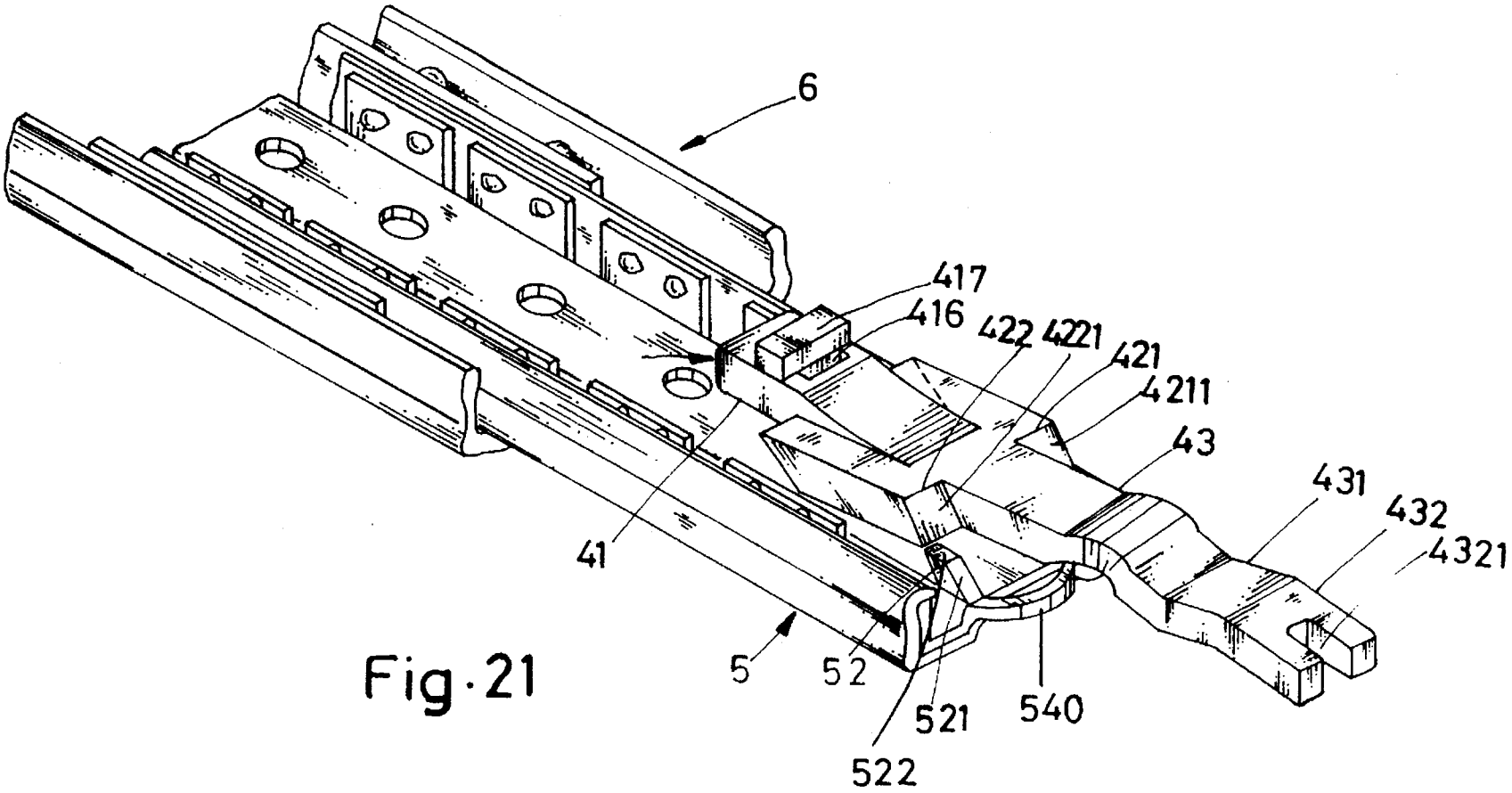
FIG. 21 is similar to FIG. 19 but showing the second stop plate disengaged from the projecting blocks of the first stop plate.
Figure 22:
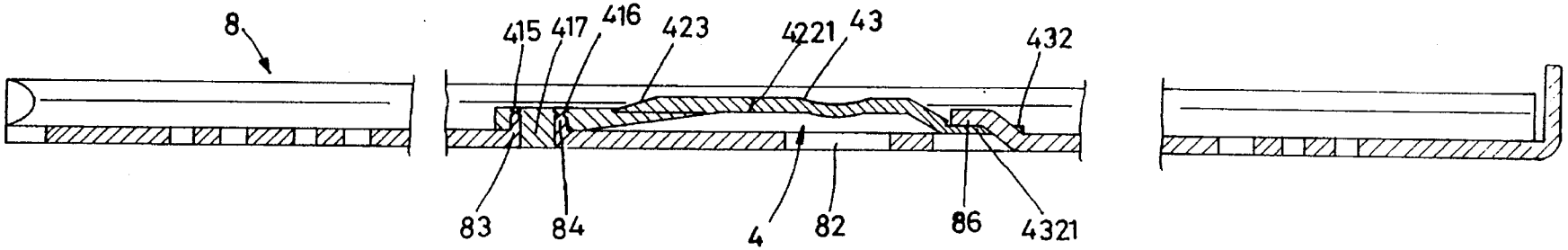
FIG. 22 is a longitudinal view in section showing the second stop plate fastened to the inner rail according to the present invention.
Figure 23:
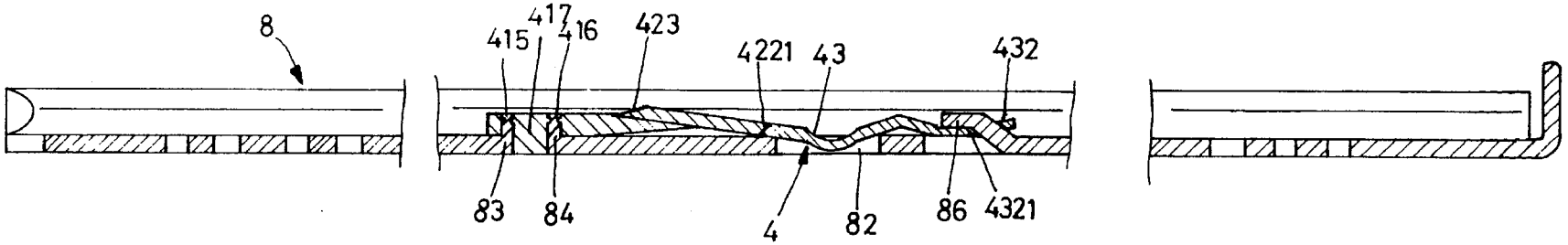
FIG. 23 is similar to FIG. 22 but showing the press portion the second stop plate depressed and the retaining portion thereof curved toward the through hole on the inner rail.
Figure 24:
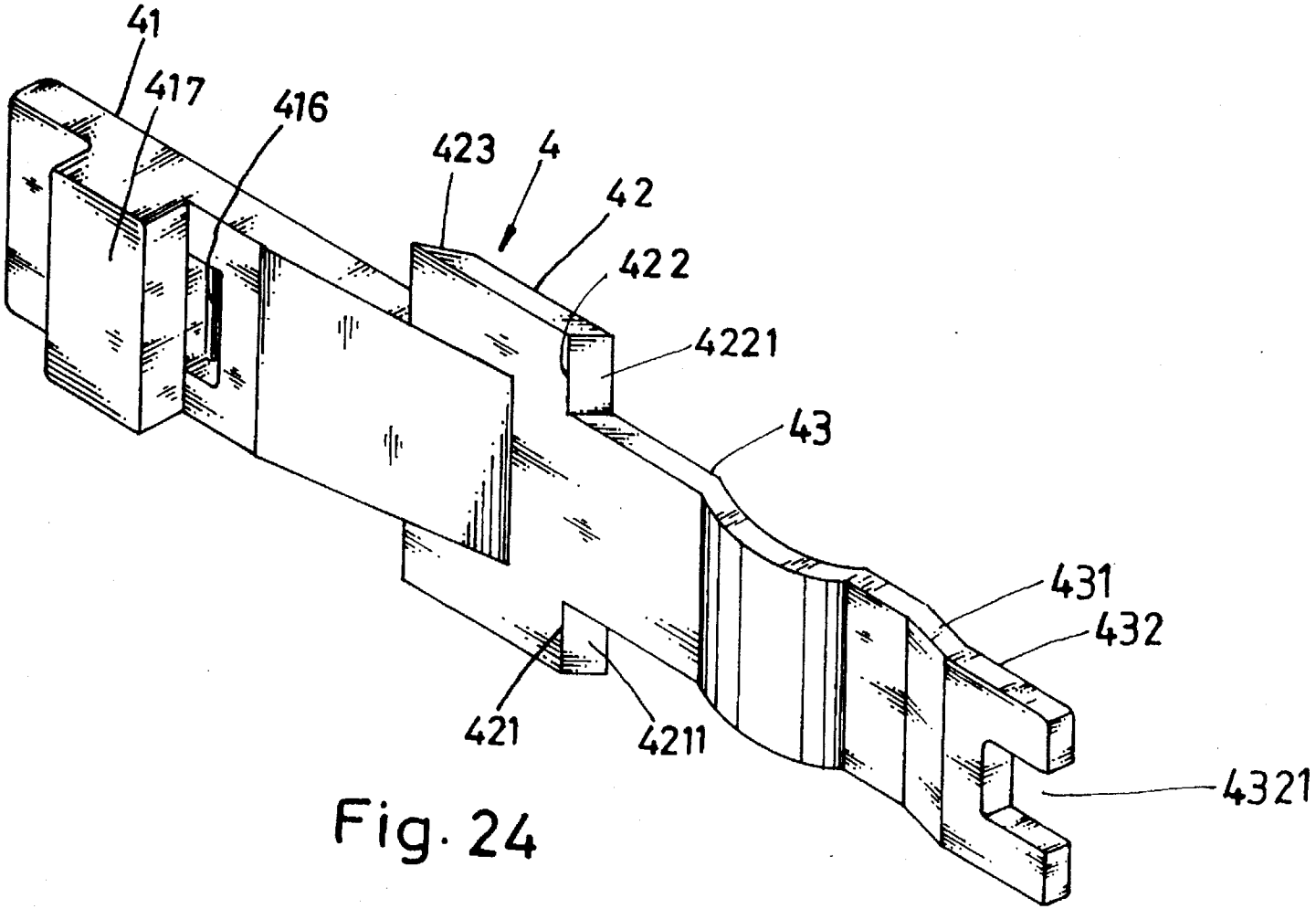
FIG. 24 is an elevational view of the second stop plate taken from another angle.
Figure 26:
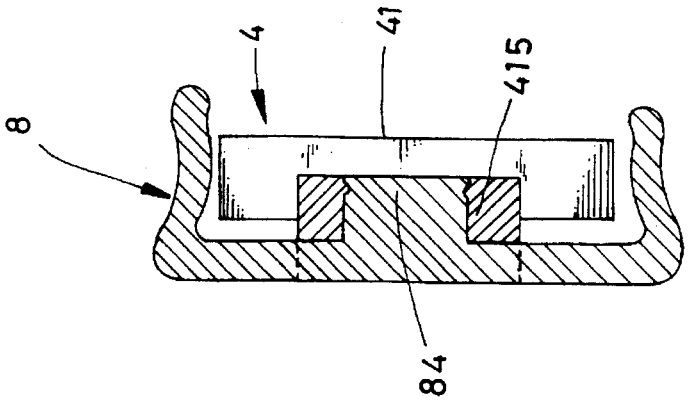
FIG. 26 is a sectional view taken along line 26—26 of FIG. 25.
Figure 25:
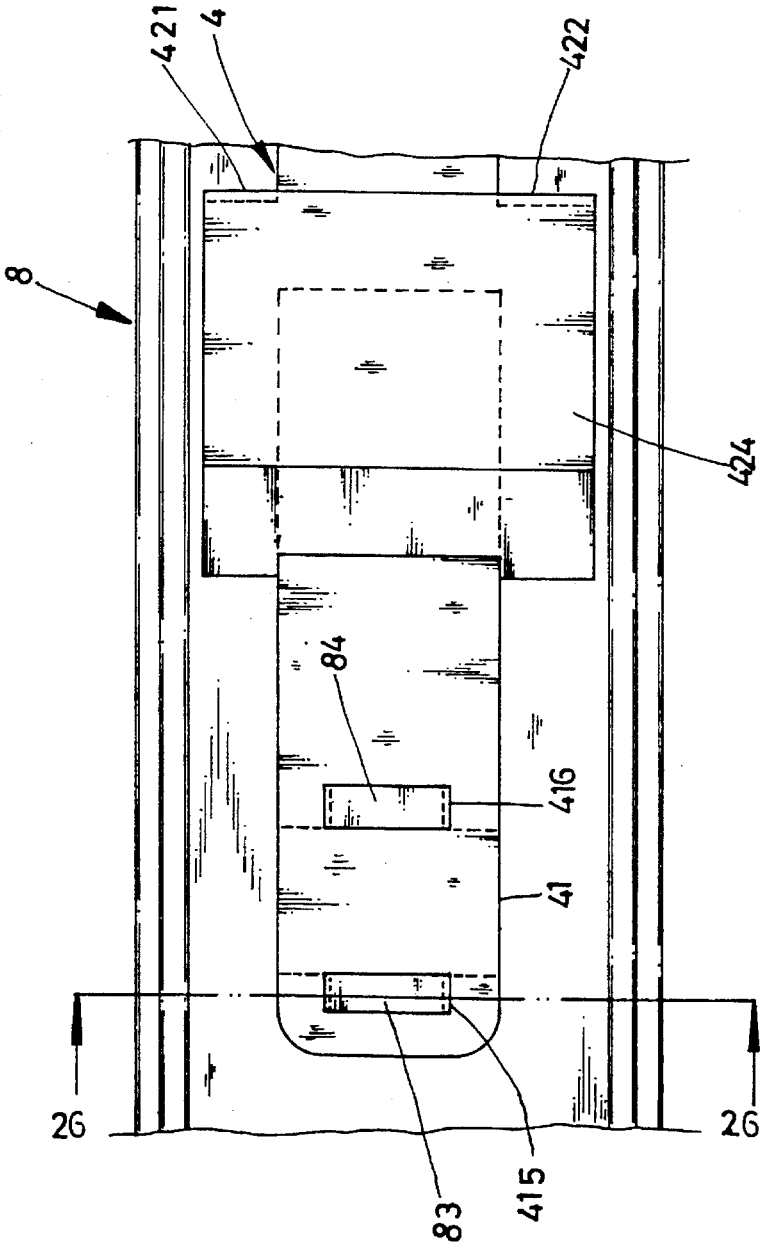
FIG. 25 is a plain view in an enlarged scale showing the second stop plate fastened to the inner rail according to the present invention.

The main features of the present invention is outlined herinafter with reference to Figures from 15 to 26. The second stop plate 4, as illustrated in FIGS. 16 and 17, comprises a locating portion 41 of width slightly smaller than the distance of pitch between the two projecting blocks 51 and 52 of the first stop plate 5 and of thickness slightly longer than the thickness of the projecting blocks 51 and 52, a retaining portion 42 longitudinally extended from one end 411 of the locating portion 41 and made of width slightly longer than the distance between the two projecting blocks 51 and 52 of the first stop plate 5 and defining two opposite projecting portions 421 and 422 at two opposite lateral sides, a press portion 43 longitudinally extended from the retaining portion 42 opposite to the locating portion 41 and made of width slightly shorter than the distance between the two projecting blocks 51 and 52 of the first stop plate 5, a forked retaining tail 432 defining a retaining notch 4321, and a bend 431 connected between the press portion 43 and the forked retaining tail 432. The lowest surface portion 4311 of the bent 431 is disposed approximately at the same elevation of the bottom surface portion 412 of the locating portion 41, and therefore a space 40 is defined between the locating portion 41 and the press portion 43 over the retaining portion 42 (see FIG. 18). The space 40 matches with a through hole 82 on the inner rail 8 (see FIG. 22). Therefore, when the press portion 43 is depressed, the retaining portion 42 is forced to curve downwards (see FIGS. 22 and 23) and to disengage from the projecting blocks 51 and 52 of the first stop plate 5 for allowing the drawer 10 to be disconnected from the cabinet 1. The press portion 43 is made of curved shape so that it can be quickly by the sense of touch without through the sense of sight. When the press portion 43 is released, it immediately returns to its former shape. A sloping surface portion 423 is connected between the retaining portion 42 and the locating portion 41 for guiding the second stop plate 4 through the projecting blocks 51 and 52 of the first stop plate 5 into the intermediate rail 7 when the drawer 10 is inserted into the cabinet 1. When the drawer 10 is inserted into the inside wall 10' of the cabinet 1, the top sides 512 and 522 of the projecting blocks 51 and 52 are guided by the sloping surface portion 423 and then moved over the top side 424 of the retaining portion 42 until the projecting blocks 51 and 52 are moved into engagement with the projecting portions 421 and 422 of the retaining portion 42 (see FIGS. 18 and 19). When the drawer 10 is set into position, it can be moved in and out of the cabinet 1. However, when the drawer 10 is pulled out of the cabinet 1, the projecting portions 421 and 422 of the retaining portion 42 will be engaged with the projecting blocks 51 and 52 (see FIGS. 18 and 19), and therefore the drawer 10 is stopped in place. When it is desired to disconnect the drawer 10 from the cabinet 1, it is can be easily done by depressing the press portion 43 of the second stop plate 4 to curve the retaining portion 42 toward the through hole 82 on the inner rail 8 (see FIGS. 20 and 23) and to disengage the projecting portions 421 and 422 of the second stop plate 4 from the projecting blocks 51 and 52 of the first stop plate 5 (see also FIGS. 20 and 21). The projecting portions 421 and 422 have a respective sloping surface portion 4211 or 4221, which engages with the sloping surface portion 511 or 521 of the respective projecting block 51 or 52 (see FIG. 19) when the drawer 10 is moved out of the cabinet 1.

The stop rods 53, 54 of the first stop plate 5 have a respective projecting portion 531. When the drawer 10 is moved out of the cabinet 1 and disconnected from it, the projecting portions 531 are stopped at the two opposite projecting portions 921 and 922 at the outer end of the second sliding ball rack 92 (see also FIG. 15). Therefore when the drawer 10 is inserted into the inside wall 10' of the cabinet 1 again, the front end 81 of the inner rail 8 can be smoothly moved over the stop rods 53, 54 into the second sliding ball rack 92 without being constrained by the projecting portions 921 and 922 of the outer end of the second sliding ball rack 92. The first stop plate 5 further comprises an arched front end 540 projecting out of the front end of the intermediate rail 7. Because the first stop plate 5 is molded from plastics, little noise will be produced when the drawer 10 is moved out of the cabinet 1 or pushed back inside the cabinet 1.

Referring to FIGS. 15, 22, 24, 25 and 26, the locating portion 41 of the second stop plate 4 comprises a projecting block 417 and two locating holes 415 and 416 at two opposite sides by the projecting block 417; the inner rail 8 is made from a metal plate by a punching machine, having a locating hole 85 and two locating strips 83 and 84 extended from the periphery of the locating hole 85 at two opposite sides in the same direction. By fitting the projecting block 417 of the locating portion 41 of the second stop plate 4 into the locating hole 85 on the inner rail 8 and hooking the two locating strips 83 and 84 of the inner rail 8 on the locating holes 415 and 416 on the locating portion 41 of the second stop plate 4, the second stop plate 4 is fixed to the inner rail 8. This mounting process can be performed by an automatic machine without the use of any rivet.

Referring to FIGS. 15 and 22 again, the inner rail 8 further comprises an unitary retainer rod 86 engaged with the retaining notch 4321 on the forked retaining tail 432 of the second stop plate 4 to hold down the second stop plate 4 in place. Because the two opposite ends (the locating portion 41 and the forked retaining tail 432) are respectively stopped at the locating hole 85 and the retainer rod 86, the retaining portion 42 is forced to curve toward the through hole 82 when the press portion 43 is.

Referring to FIGS. 22 and 23 again, the formation of the through hole 82 on the inner rail 8 to provide a space for the retaining portion 42, so that the retaining portion 42 can be curved extensively to disengage the projecting portions 421 and 422 from the projecting blocks 51 and 52 of the first stop plate 5.

The first stop plate 5 is made from plastics, having an arched front end 540 projecting out of the intermediate rail 7, therefore when the drawer is moved out of the cabinet or pushed back inside the cabinet, little noise will be produced.

I claim:

1. A sliding track assembly arranged between a cabinet and a drawer, said sliding track assembly comprising an outer rail securely fixed to an inside wall of said cabinet, an intermediate rail, an inner rail fixedly secured to a lateral side of said drawer, a first sliding ball rack slidably connected between said outer rail and said intermediate rail, and a second sliding ball rack slidably connected between said intermediate rail and said inner rail, a first stop plate fixed to said intermediate rail at an outer end and having two projecting blocks having a distance therebetween for engagement with a second stop plate on said inner rail and two stop rods for stopping said second sliding ball rack in place, a second stop plate fixed to said inner rail at an outer side, said second stop plate being engaged with the projecting blocks of said first stop plate to stop said drawer in place when said drawer is pulled out of said cabinet, said second stop plate comprising a locating portion of a width slightly smaller than the distance between the two projecting blocks of said first stop plate and of a thickness slightly longer than the thickness of the projecting blocks of said first stop plate, the locating portion of said second stop plate being fixed to said inner rail, a retaining portion longitudinally extended from one end of the locating portion of said second stop plate and made of a width slightly longer than the distance between the two projecting blocks of said first stop plate and deeming two opposite projecting portions at two opposite lateral sides, a press portion longitudinally extended from the retaining portion of said second stop plate opposite to the locating portion of said second stop plate and made of a width slightly shorter than the distance between the two projecting blocks of said first stop plate, a forked retaining tail defining a retaining notch and fastened to said inner rail, and a bend connected between said press portion and said forked retaining tail, the retaining portion and press portion of said second stop plate being spaced from said inner tail by a space, the retaining portion of said second stop plate being forced to curved toward said inner rail and to disengage from said first stop plate when said press portion is depressed, for allowing said drawer to be disconnected from said cabinet, the retaining portion of said second stop plate having a sloping surface portion connected to the locating portion of said second stop plate and two projecting portions remote from the sloping surface portion thereof, the sloping surface portion surface portion of the retaining portion of said second stop plate being to guide said second stop plate through the projecting blocks of said first stop plate into said intermediate rail when said drawer is inserted into said cabinet, the projecting blocks of said first stop plate having a respective top side, which is guided by the sloping surface portion of the retaining portion of said second stop plate to pass over the retaining portion of said second stop plate into engagement with two projecting portions of the retaining portion of said second stop plate when said drawer is inserted into the inside wall of said cabinet, the projecting portions of the retaining portion of said second stop plate being engaged with the projecting blocks of said first stop plate to stop said drawer in place when said drawer is pulled out of said cabinet, said drawer being disconnected from said cabinet when said press portions of said second stop plate is depressed to curve the retaining portion of said second stop plate and to disengage the projecting portions of the retaining portion of said second stop plate from the projecting blocks of said first stop plate.

2. The sliding track assembly of claim 1 wherein the stop rods of said first stop plate have a respective projecting portion, the projecting portions of said stop rods of said first stop plate being bilaterally stopped at one end of said second sliding ball rack when said drawer is moved out of said cabinet and disconnected from it, such that when said drawer is inserted into said cabinet again, said inner rail is moved over said stop rods of said first stop plate into said second sliding ball rack without being constrained by said second sliding ball rack.

3. The sliding track assembly of claim 1 wherein the projecting portions of the retaining portion of said second stop plate have a respective sloping surface portion, the projecting blocks of said first stop plate have a respective sloping surface portion for engagement with the sloping surface portion on the respective projecting portion of the retaining portion of said second stop plate.

4. The sliding track assembly of claim 1 wherein the locating portion of said second stop plate compresses a projecting block and two locating holes at two opposite sides by the projecting block of the locating portion of said second stop plate; said inner rail comprises a locating hole engaged with the projecting block of said locating portion of said second stop plate, and two locating strips respectively hooked on the locating holes of the locating portion of said second stop plate.

5. The sliding track assembly of claim 1 wherein said inner rail further comprises a retainer rod engaged with the retaining notch on the forked retaining tail of said second stop plate.

6. The sliding track assembly of claim 1 wherein said inner rail further comprises a through hole for receiving the retaining portion of said second stop plate when the retaining portion of said second stop plate is deformed to disengage from the projecting blocks of said first stop plate.

7. The sliding track assembly of claim 1 wherein said first stop plate has an arched front end.

* * * * *